US010959531B2

(12) United States Patent
Riggs et al.

(10) Patent No.: US 10,959,531 B2
(45) Date of Patent: Mar. 30, 2021

(54) SLEEP CHAMBER

(71) Applicants: Randall A. Riggs, Kokomo, IN (US); Jennifer Riggs, Kokomo, IN (US)

(72) Inventors: Randall A. Riggs, Kokomo, IN (US); Jennifer Riggs, Kokomo, IN (US)

( * ) Notice: Subject to any disclaimer, the term of this patent is extended or adjusted under 35 U.S.C. 154(b) by 231 days.

(21) Appl. No.: 16/125,553

(22) Filed: Sep. 7, 2018

(65) Prior Publication Data

US 2019/0069685 A1 Mar. 7, 2019

Related U.S. Application Data

(60) Provisional application No. 62/555,609, filed on Sep. 7, 2017.

(51) Int. Cl.

| | |
|---|---|
| ***A47C 19/22*** | (2006.01) |
| ***A47C 21/00*** | (2006.01) |
| ***A47C 29/00*** | (2006.01) |
| *A61G 7/05* | (2006.01) |
| *A61G 10/00* | (2006.01) |

(52) U.S. Cl.

CPC ..... *A47C 19/22* (2013.01); *A47C 21/003* (2013.01); *A47C 29/003* (2013.01); *A61G 7/0526* (2013.01); *A61G 10/00* (2013.01); *A61G 10/005* (2013.01)

(58) Field of Classification Search

CPC ..... A47C 19/22; A47C 21/003; A47C 21/022; A47C 21/024; A47C 29/00; A47C 29/003; A61G 7/0526; A61G 10/00; A61G 10/005

See application file for complete search history.

(56) References Cited

U.S. PATENT DOCUMENTS

| | | | | |
|---|---|---|---|---|
| 4,017,917 | A * | 4/1977 | Brown | A61F 5/3769 5/617 |
| 4,109,331 | A * | 8/1978 | Champeau | A47C 21/00 5/284 |
| 4,305,168 | A * | 12/1981 | Holter | A47C 21/044 5/284 |
| 5,832,919 | A * | 11/1998 | Kano | A61G 10/005 128/205.26 |
| 5,950,625 | A * | 9/1999 | Bongiovanni | A62B 31/00 128/845 |
| 8,276,223 | B1 * | 10/2012 | Connor | A47C 21/00 5/423 |
| 2005/0085686 | A1 * | 4/2005 | Yuen | A61G 10/005 600/21 |
| 2012/0123192 | A1 * | 5/2012 | Somsundaram | A61G 7/0526 600/28 |
| 2014/0318586 | A1 * | 10/2014 | Watson | A47C 29/003 135/90 |
| 2018/0310720 | A1 * | 11/2018 | Holland | A47C 21/003 |
| 2019/0183254 | A1 * | 6/2019 | Blackett | A47C 21/003 |

* cited by examiner

*Primary Examiner* — Robert G Santos
*Assistant Examiner* — Rahib T Zaman
(74) *Attorney, Agent, or Firm* — Runyan Law; Charles Runyan

(57) ABSTRACT

An enclosure for installation on a bed. The enclosure includes an enclosure-frame, an attachment-bracket, a foldable-board and a canopy. In some embodiments, the enclosure includes a power-supply, vents, fans, speakers and lights. The enclosure is useful for providing a user with a peaceful night sleep by preventing external noises and light from disrupting the user.

18 Claims, 6 Drawing Sheets

SLEEP CHAMBER

CROSS REFERENCE TO RELATED APPLICATION

The present application is related to and claims priority to U.S. Provisional Patent Application No. 62/555,609 filed Sep. 7, 2017, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of enclosures and more specifically relates to a sleep enclosure for installation on a bed.

2. Description of Related Art

Sleep is a naturally recurring state of mind and body, characterized by altered consciousness, relatively inhibited sensory activity, inhibition of nearly all voluntary muscles, and reduced interactions with surroundings. During sleep, most of the body's systems are in an anabolic state, helping to restore the immune, nervous, skeletal, and muscular systems; these are vital processes that maintain mood, memory, and cognitive function, and play a large role in the function of the endocrine and immune systems. Noise has become a major source of nuisance in great urban centers and even in the smallest villages, for example, those traversed by roads with high traffic density or situated in the vicinity of airports. The noise is much more apparent and objectionable at night when it can seriously disturb sleep. Lack of sleep due to environmental noise can create havoc to one's health, productivity, and overall quality of life. Sleep-disturbing noise can even come from one's own household. For example, loud snoring can have devastating effects on one's closest personal relationships. Thus, a suitable solution is desired.

U.S. Pat. No. 8,276,223 to Robert A. Connor relates to a sleeping enclosure with assured ventilation. The described sleeping enclosure with assured ventilation includes a sleeping enclosure with a high degree of insulation against environmental noises while also providing assured ventilation within the enclosure. It features an active ventilation means and a passive ventilation means that are physically linked so that there is always one of them providing ventilation. This linkage combines the superior sound-insulating properties of active ventilation (such as a longer air conduit for reduced intrusion of environmental noises into the enclosure) with the superior safety properties of passive ventilation (such as not being vulnerable to power failure or mechanical failure).

BRIEF SUMMARY OF THE INVENTION

In view of the foregoing disadvantages inherent in the known enclosures art, the present disclosure provides a novel sleep chamber. The general purpose of the present disclosure, which will be described subsequently in greater detail, is to provides an enclosure for attachment to a bed to promote sleep and prevent noise disturbances.

An enclosure is disclosed herein. The enclosure includes an enclosure-frame which may include a front-side and a back-side opposite the front-side. An attachment-bracket (suitable means) may be attached to the back-side of the enclosure-frame and configured to attach the enclosure to the attachment-surface of the bed. Further, a foldable-board may be attached about the front-side of the enclosure-frame. The foldable-board may include a second horizontal-length and a board-periphery. The second horizontal-length may be defined by a board top-end and a board bottom-end and may be manipulable between a folded-state and an unfolded-state. The unfolded-state may include the second horizontal-length. In addition, a canopy may be attached to the board-periphery and may include an enclosed-state and an open-state. The enclosed-state may be configured to substantially enclose the bed.

A method of using the enclosure (enclosing means) is also disclosed herein. The method of using enclosure may comprise the steps of: providing the enclosure as above; attaching the enclosure to the attachment-surface of the bed via the attachment-bracket (or other suitable means); unfolding the foldable-board into the unfolded-state; getting into the bed; and releasing the canopy into the enclosed-state.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a sleep chamber, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to enclosures and more particularly to a sleep chamber as used to improve sleep for users by providing an efficient and effective sleep enclosure for installation on a bed.

Generally disclosed is a chamber including a combination cover/enclosure that may be attached to a head board or wall and extended over a bed to create the chamber for sleeping. The chamber may create a closed and shaded area with ventilation, BLUETOOTH speakers and total darkness to enhance a users' sleeping experience. The cover may also shut out noise made by a snoring partner. The chamber may fold out on hinges when in use and fold back in against the wall or headboard after the user wakes.

The chamber may include a first-section and a second-section in foldable combination. The first-section and the second-section may be supported by two support posts which are configured to be attached to the headboard or the wall. The first-section and second-section each may have a separate curtain including a light blocking and sound dampening material attached to the frame.

Referring now more specifically to the drawings by numerals of reference, there is shown in FIGS. 1-5, various views of an enclosure 100.

Figure 1:
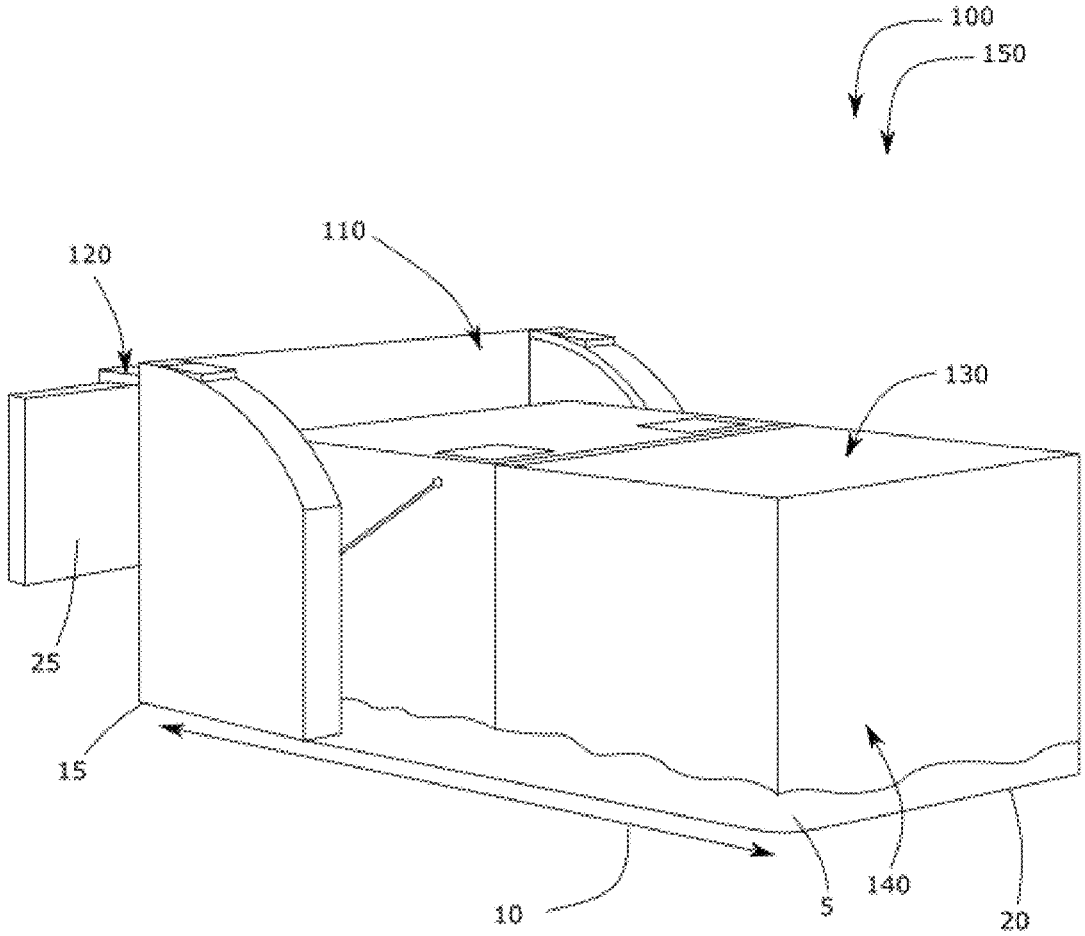
FIG. 1 is a front-side perspective view of the enclosure during an 'in-use' condition, according to an embodiment of the disclosure.

FIG. 1 shows an enclosure 100 during an 'in-use' condition 150 according to an embodiment of the present disclosure. As Illustrated, the enclosure 100 may include an enclosure-frame may include an enclosure-frame 110, an attachment-bracket 120, a foldable-board 130, and a canopy 140. As shown, the enclosure 100 may be for installation on bed 5. The bed 5 may include a first horizontal-length 10 being defined by a bed top-end 15 and a bed bottom-end 20, the bed top-end 15 having an attachment-surface 25. The enclosure may be particularly useful for promoting a peaceful night sleep to the user by providing silence, darkness, etc. to the user.

Figure 2A:
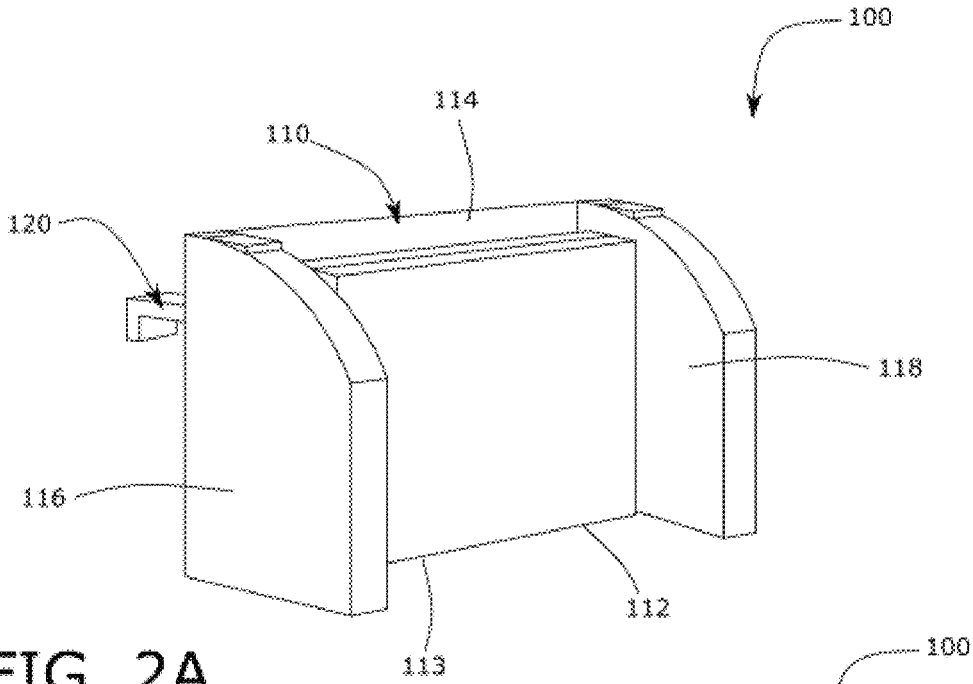
FIG. 2A is a front-side perspective view of the enclosure of FIG. 1, according to an embodiment of the present disclosure.
Figure 2B:
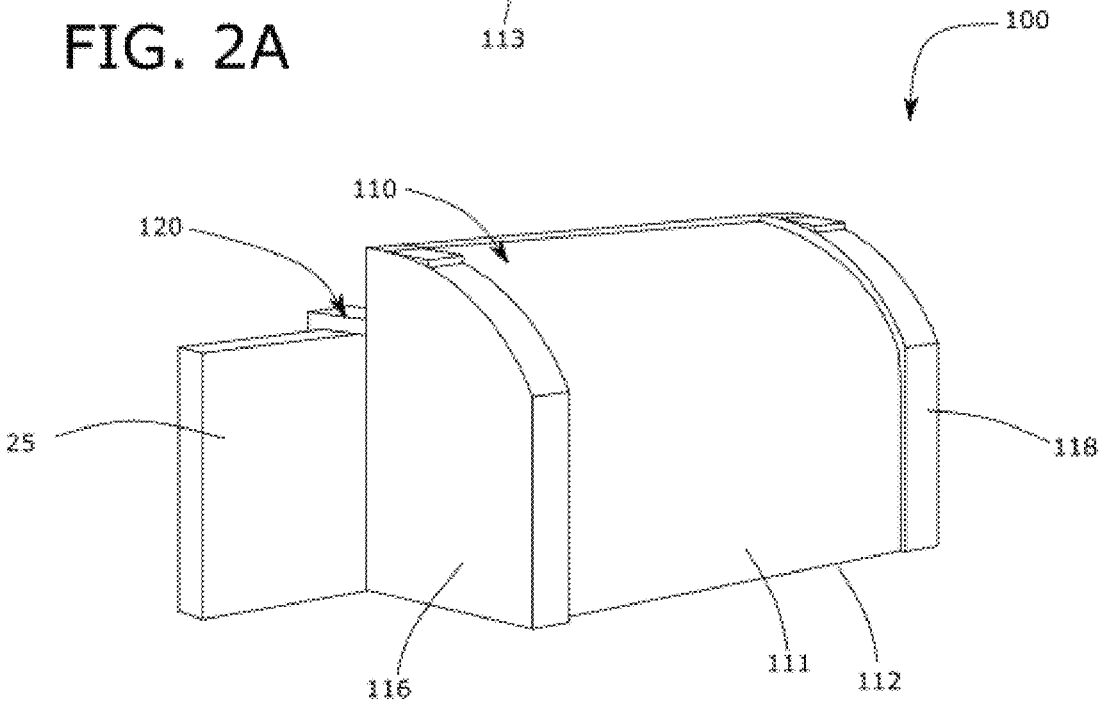
FIG. 2B is a front-side perspective view of the enclosure of FIG. 1, according to an embodiment of the present disclosure.

Referring now to FIGS. 2A-2B showing front-side perspective views of the enclosure 100 of FIG. 1, according to an embodiment of the present disclosure. The enclosure-frame 110 may include a front-side 112 and a back-side 114 opposite the front-side 112. In a preferred embodiment, the enclosure-frame 110 may further include a right-side 116 and a left-side 118 relative to the bed 5 (FIG. 1). As shown, the back-side 114, the left-side 118 and the right-side 116 of the enclosure-frame 110 may be a back-board, a left-board and a right-board, and the back-side 114, the left-side 118 and the right-side 116 may define a storage-capacity 113. The front-side 112 of the enclosure-frame 110 may be substantially open. A pull-down cover 111 may be provided and configured to cover the substantially open front-side 112. The pull-down cover 111 may include a decorative-surface to provide an aesthetically pleasing appearance when the enclosure-frame 110 is not in use.

As shown, the attachment-bracket 120 may be attached to the back-side 114 of the enclosure-frame 110 and configured to attach the enclosure to the attachment-surface 25 of the bed. In a preferred embodiment, the attachment-surface 25 may be a headboard and the attachment-bracket 120 may include an L-shape configured to attach to the headboard. In another embodiment, the attachment-surface 25 may be a wall and the attachment-bracket 120 may include apertures for affixing the attachment-bracket 120 to the wall. The attachment-bracket 120 then be fastened to the attachment-surface 25 via screws, adhesives, etc. The attachment-bracket 120 may be adjustable to allow the attachment-bracket 120 to attach to any sized attachment-surface 25.

Figure 3A:
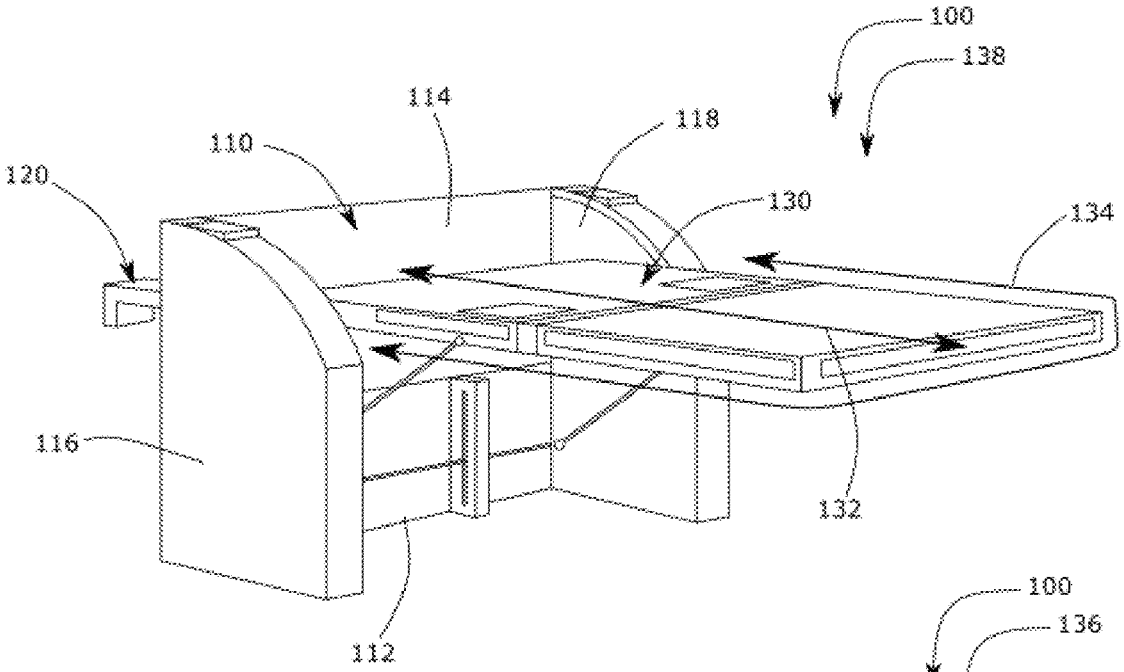
FIG. 3A is a front-side perspective view of the enclosure of FIG. 1, according to an embodiment of the present disclosure.
Figure 3B:
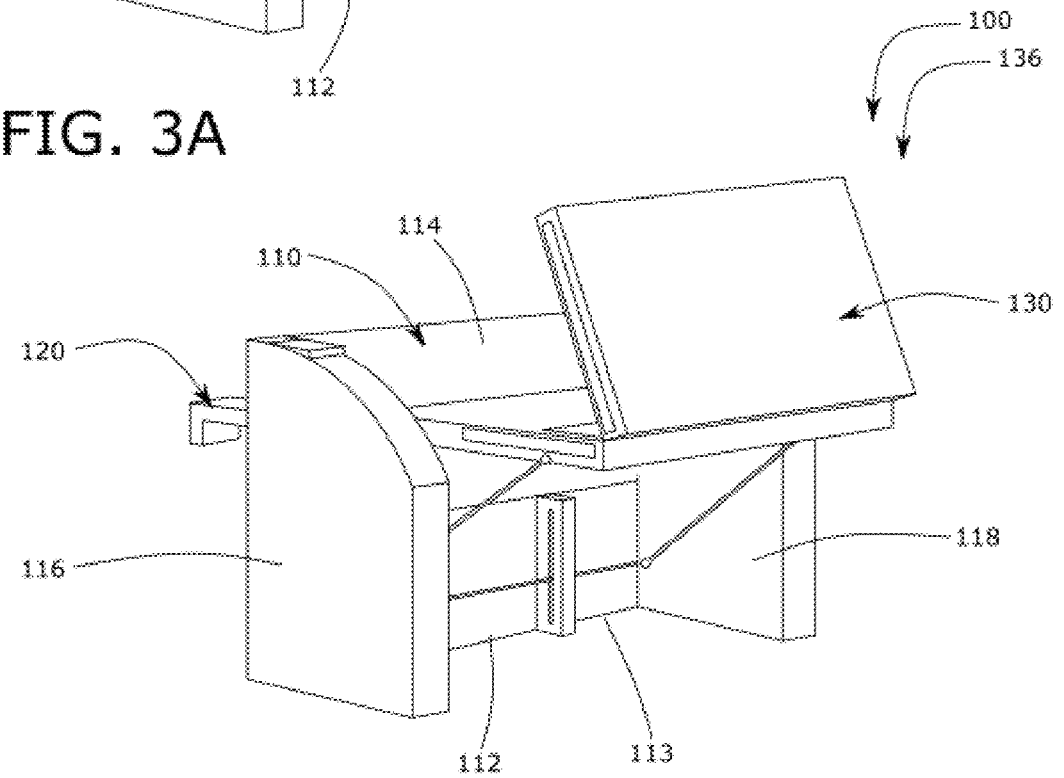
FIG. 3B is a front-side perspective view of the enclosure of FIG. 1, according to an embodiment of the present disclosure.

FIGS. 3A-3B show front-side perspective views of the enclosure 100 of FIG. 1, according to an embodiment of the present disclosure. The foldable-board 130 may be attached about the front-side 112 of the enclosure-frame 110. As shown here, a board top-end may be attached to the left-side 118 and the right-side 116 of the enclosure-frame 110, at a board left-side 118 and board right-side 116 of the foldable-board 130. The board left-side 118 may be attached to the left-side 118 of the enclosure-frame 110 via a first swivel joint, and the board right-side 116 may be attached to the right-side 116 of the enclosure-frame 110 via a second swivel joint. The first swivel joint and the second swivel joint may aid in manipulation between a folded-state 136 and an unfolded state 138.

As shown, the foldable-board 130 may include a second horizontal-length 132 and a board-periphery 134. The horizontal-length may be defined by the board top-end and a board bottom-end and may be manipulable between the folded-state 136 and the unfolded-state 138; the unfolded-state 138 including the second horizontal-length 132. Also shown here is the foldable-board 130 in the folded-state 136. The foldable-board 130 may be configured for storage within the storage-capacity 113 when in the folded-state 136.

Figure 4A:
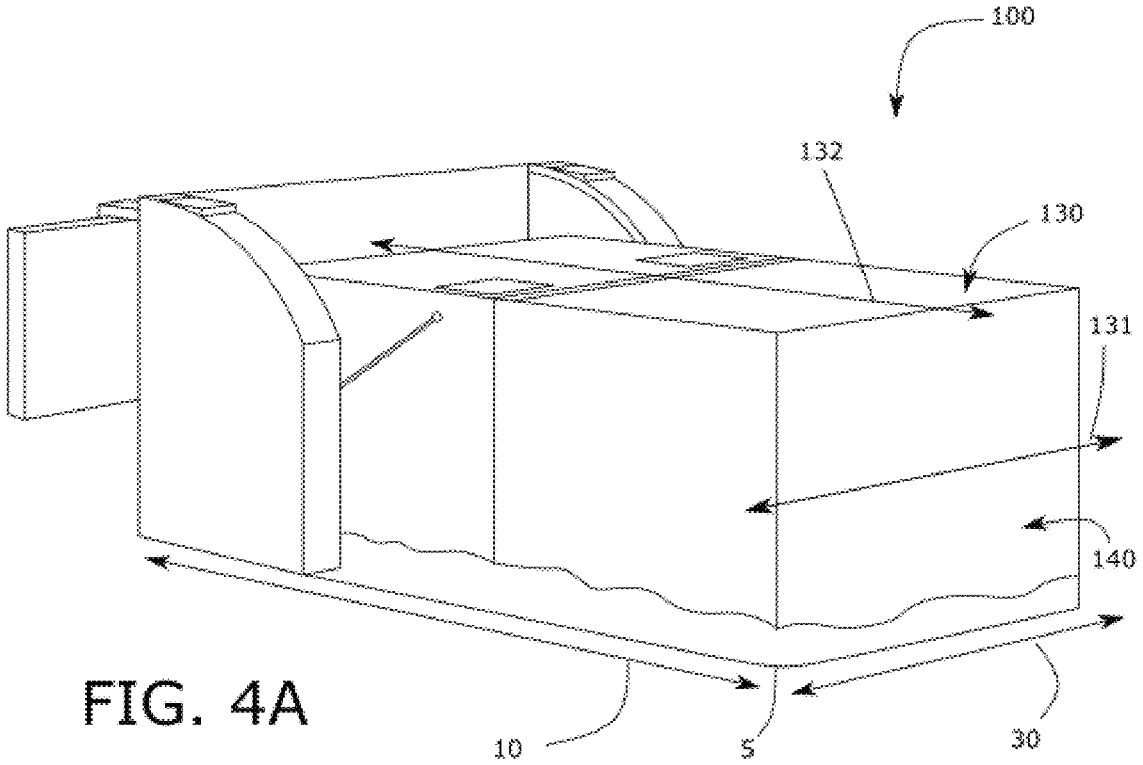
FIG. 4A is a front-side perspective view of the enclosure of FIG. 1, according to an embodiment of the present disclosure.
Figure 4B:
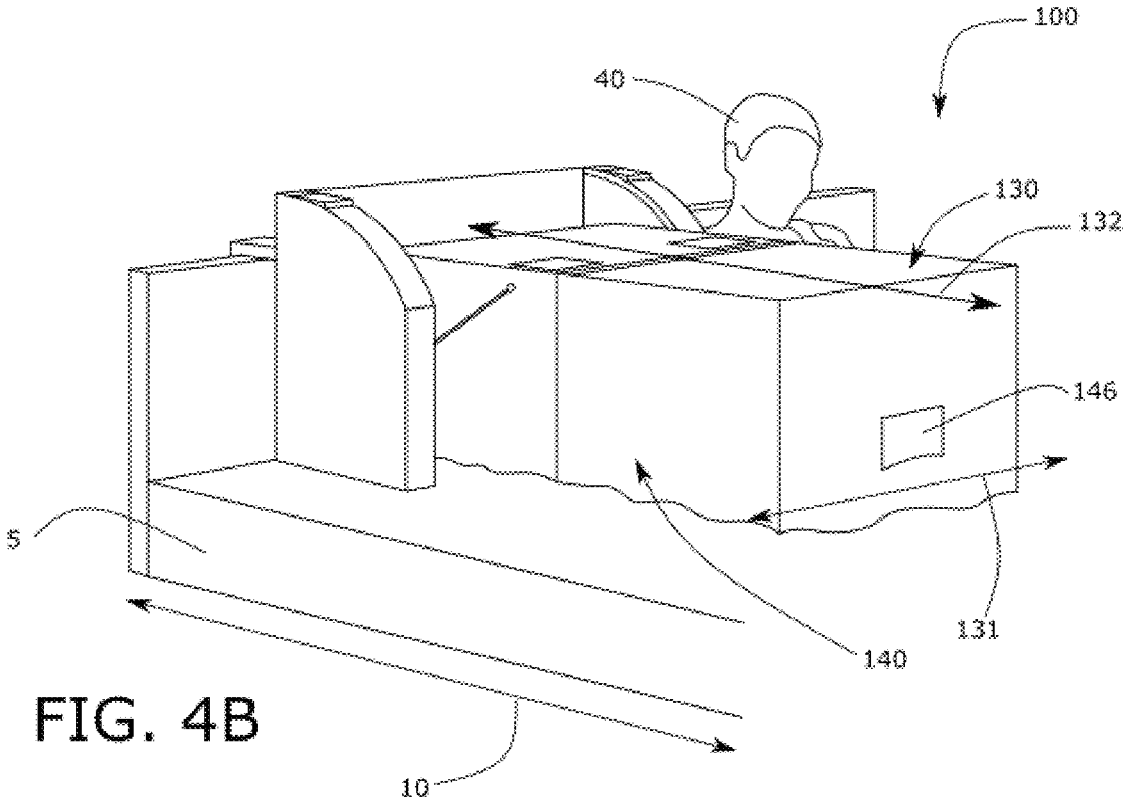
FIG. 4B is a front-side perspective view of the enclosure of FIG. 1, according to an embodiment of the present disclosure.

Referring now to FIGS. 4A-4B showing front-side perspective views of the enclosure 100 of FIG. 1, according to an embodiment of the present disclosure. In on embodiment, the first horizontal-length 10 and the second horizontal-length 132 may be equal in length. In this embodiment, a board-width 131 of the foldable-board 130 in the unfolded-state 138 may be equal to a bed-width 30 of the bed 5. As shown, in this embodiment the enclosure may enclose the entire bed. The enclosure 100 may be sized to enclose different bed sizes, such as single, double, queen, king, etc. In another embodiment, the second horizontal-length 132 may be at least half of the first horizontal-length 10. Further, the board-width 131 of the foldable-board 130 in the unfolded-state 138 may be at least half of the bed-width 30 of the bed 5. In this embodiment, the enclosure 100 may enclose half of the bed 5. For example, the enclosure 100 in this embodiment may be used by one user 40 of the bed 5, whilst another user 40 is uncovered.

The canopy 140 may be attached to the board-periphery 134 and include an enclosed-state and an open-state. The enclosed-state may be configured to substantially enclose the bed. Further to this, the canopy 140 may comprise vents 146 therein. The vents 146 may be particularly useful to allow air circulation and ventilation when the enclosure 100 is in use.

Figure 5:
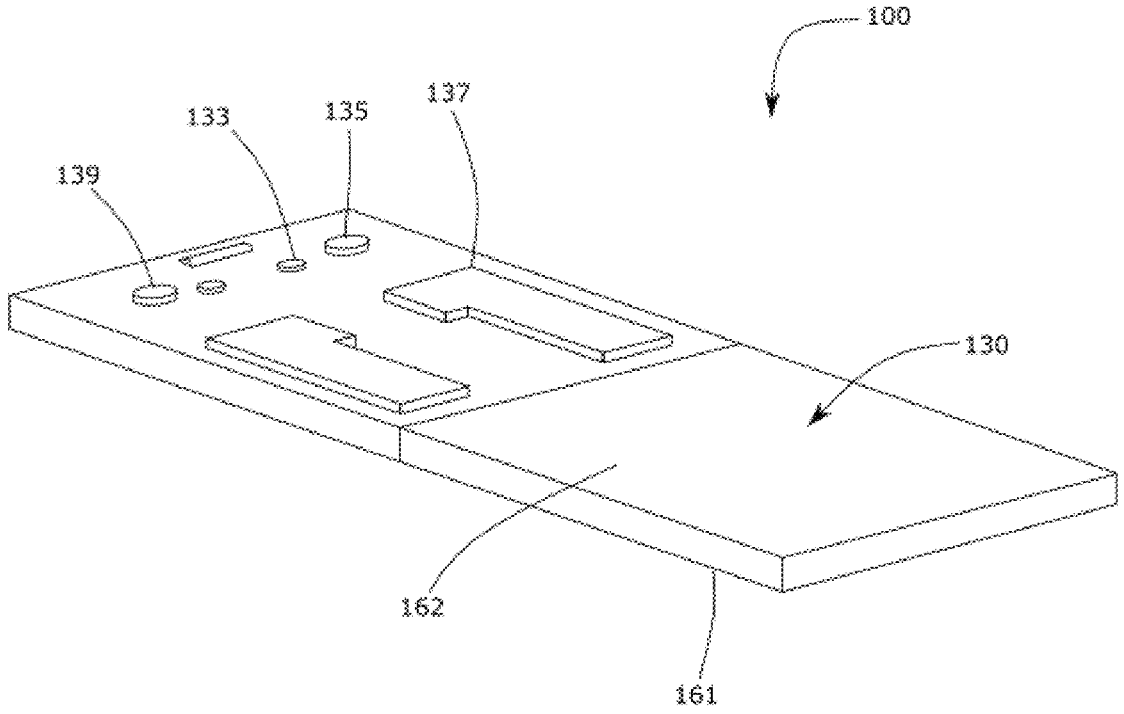
FIG. 5 is a front-side perspective view of the enclosure of FIG. 1, according to an embodiment of the present disclosure.

FIG. 5 shows a front perspective view of the enclosure 100 of FIG. 1, according to an embodiment of the present disclosure. As shown, the foldable-board 130 may further include a power-supply 133. The power-supply 133 may be used to supply power to a plurality of electrical devices and appliances. The devices and appliances may be integrated into the foldable-board 130. For example, a fan 135 may be electrically-connected to the power-supply 133. The fan 135 may be utilized to aid in the air circulation and provide the user 40 with a comfortable sleep and breathability.

The foldable-board 130 may include a top-surface 161 and a bottom-surface 162 relative to the bed. In the preferred embodiment, the foldable-board 130 may include an entertainment-center 137 electrically-connected to the power-supply 133. The entertainment-center 137 may be located on the bottom-surface of the bed such that the user 40 may be able to view the devices within the entertainment-center when the enclosure 100 is in use. The entertainment-center 137 may include at least one speaker 139. Further, the entertainment-center 137 may include lighting means such as LED lights. In other embodiments, the entertainment-center 137 may include an electronic-display such as a computer, television, tablet, etc.

Figure 6:
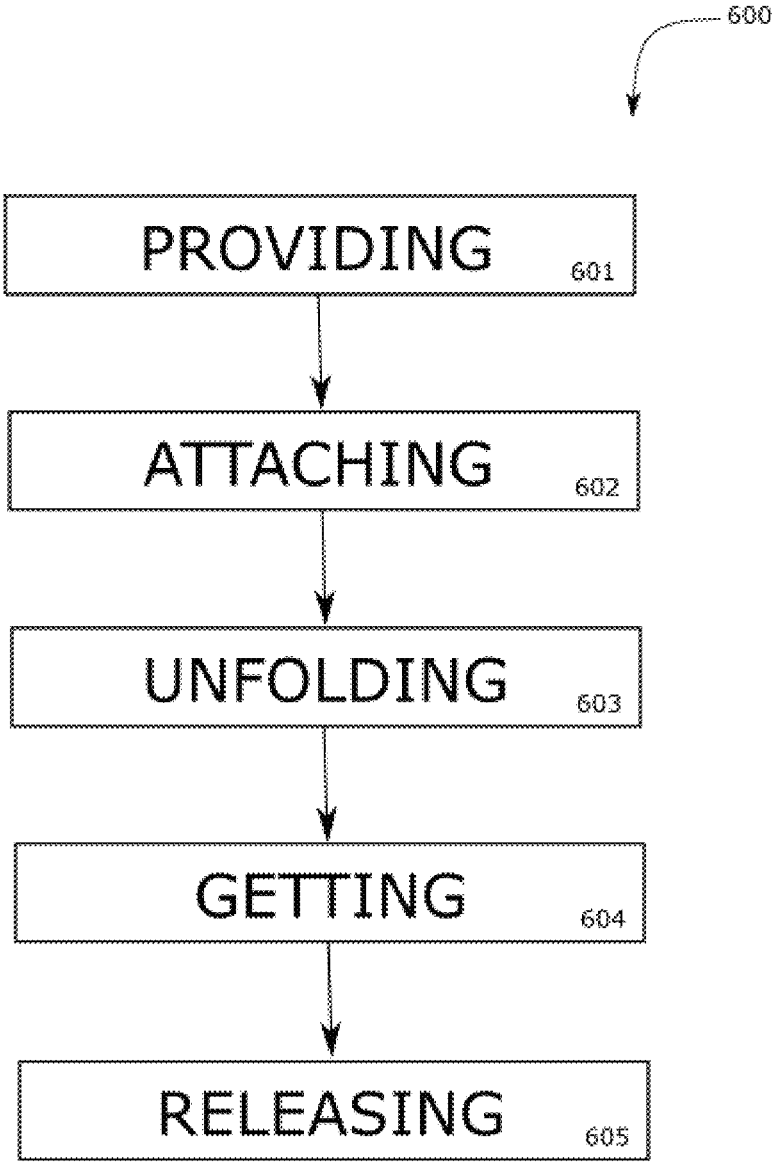
FIG. 6 is a flow diagram illustrating a method of use for the enclosure, according to an embodiment of the present disclosure.

Referring now to FIG. 6 showing a flow diagram illustrating a method of using an enclosure 600, according to an embodiment of the present disclosure. As illustrated, the method of using an enclosure 600 may include the steps of: step one 601, providing the enclosure 100 as above; step two 602, attaching the enclosure to the attachment-surface 25 of the bed via the attachment-bracket 120; step three 603, unfolding the foldable-board 130 into the unfolded-state 138; step four 604, getting into the bed 5; and step five 605, releasing the canopy 140 into the enclosed-state 142.

It should be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for using/installing enclosure 100 (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

The invention claimed is:

1. An enclosure for installation on a bed via a bed attachment-surface, the enclosure comprising: an enclosure-frame including a front-side and a back-side opposite the front-side; an attachment-bracket attached to the back-side of the enclosure-frame, the attachment-bracket being configured to attach the enclosure to the attachment-surface of the bed; a foldable-board attached about the front-side of the enclosure-frame, the foldable-board including a second horizontal-length and a board-periphery, the horizontal-length being defined by a board top-end and a board bottom-end, the second horizontal-length being manipulable between a folded-state and an unfolded-state, and wherein the unfolded-state includes the second horizontal-length; and a canopy attached to the board-periphery, the canopy including an enclosed-state and an open-state, and wherein the enclosed-state is configured to substantially enclose the bed.

2. The enclosure-frame of claim 1, wherein the enclosure-frame further includes a right-side and a left-side relative to the bed.

3. The enclosure-frame of claim 1, wherein the front-side of the enclosure-frame is substantially open.

4. The enclosure-frame of claim 3, wherein the enclosure-frame further includes a pull-down cover configured to cover the substantially open front-side.

5. The enclosure-frame of claim 1, wherein the enclosure-frame further includes a right-side, a left-side, and a back-side, wherein the sides define a storage-capacity.

6. The enclosure-frame of claim 5, wherein the foldable-board is configured for storage within the storage-capacity when in the folded-state.

7. The enclosure-frame of claim 1, wherein the first horizontal-length and the second horizontal-length are equal in length.

8. The enclosure-frame of claim 7, wherein a board-width of the foldable-board in the unfolded-state is equal to a bed-width of the bed.

9. The enclosure-frame of claim 1, wherein the board-width of the foldable-board in the unfolded-state is at least half of the bed-width of the bed.

10. The enclosure-frame of claim 9, wherein the second horizontal-length is at least half of the first horizontal-length.

11. The enclosure-frame of claim 1, wherein the canopy further comprises vents therein.

12. The enclosure-frame of claim 1, wherein the foldable-board further includes a power-supply.

13. The enclosure-frame of claim 12, wherein the foldable-board further includes a top-surface and a bottom-surface relative to the bed.

14. The enclosure-frame of claim 12, wherein the foldable-board further includes at least one fan electrically-connected to the power-supply.

15. The enclosure-frame of claim 14, wherein the foldable-board further includes an entertainment-center electrically-connected to the power-supply.

16. The enclosure-frame of claim 15, wherein the entertainment-center includes at least one speaker.

17. An enclosure for installation on a bed via a bed attachment-surface, the enclosure comprising: an enclosure-frame including a front-side and a back-side opposite the front-side an attachment-bracket attached to the back-side of the enclosure-frame, the attachment-bracket connecting the enclosure to the attachment-surface; a foldable-board attached about the front-side of the enclosure-frame, the foldable-board including a second horizontal-length and a board-periphery, the horizontal-length being defined by a board top-end and a board bottom-end, the second horizontal-length being manipulable between a folded-state and an unfolded-state, and wherein the unfolded-state includes the second horizontal-length and a canopy attached to the board-periphery, the canopy including an enclosed-state and an open-state, and wherein the enclosed-state is configured to substantially enclose the bed; and wherein the enclosure-frame further includes a right-side and a left-side relative to the bed; wherein the front-side of the enclosure-frame is substantially open; wherein the enclosure-frame further includes a pull-down cover configured to cover the substantially open front-side; wherein the back-side, the left-side and the right-side of the enclosure-frame defines a storage-capacity; wherein the foldable-board is configured for storage within the storage-capacity when in the folded-state; wherein the attachment-surface is a headboard and the attachment-bracket includes an L-shape configured to attach to the headboard; wherein the first horizontal-length and the second horizontal-length are equal in length; wherein a board-width of the foldable-board in the unfolded-state is equal to a bed-width of the bed; wherein the canopy further comprises vents therein; wherein the foldable-board further includes a power-supply; wherein the foldable-board further includes a top-surface and a bottom-surface relative to the bed; wherein the foldable-board further includes at least one fan electrically-connected to the power-supply; wherein the foldable-board further includes an entertainment-center electrically-connected to the power-supply; and wherein the entertainment-center includes at least one speaker.

18. A method comprising the steps of:

providing an enclosure for installation on a bed via a bed attachment-surface, the enclosure comprising:

an enclosure-frame including a front-side and a back-side opposite the front-side;

an attachment-bracket attached to the back-side of the enclosure-frame, the attachment-bracket connecting the enclosure to the attachment-surface;

a foldable-board attached about the front-side of the enclosure-frame, the foldable-board including a second horizontal-length and a board-periphery, the horizontal-length being defined by a board top-end and a board bottom-end, the second horizontal-length being manipulable between a folded-state and an unfolded-state, and wherein the unfolded-state includes the second horizontal-length; and a canopy attached to the board-periphery, the canopy including an enclosed-state and an open-state, and wherein the enclosed-state is configured to substantially enclose the bed;

attaching the enclosure to the attachment-surface of the bed via the attachment-bracket;

unfolding the foldable-board into the unfolded-state;

getting into the bed; and releasing the canopy into the enclosed-state.

* * * * *